United States Patent [19]

Stoltz

[11] Patent Number: 4,972,606

[45] Date of Patent: Nov. 27, 1990

[54] CONTROL DAMPER FOR RADIANT OVEN

[75] Inventor: Carl R. Stoltz, Evansville, Ind.

[73] Assignee: George Koch Sons, Inc., Evansville, Ind.

[21] Appl. No.: 412,196

[22] Filed: Sep. 25, 1989

[51] Int. Cl.[5] ..... F26B 3/32

[52] U.S. Cl. ..... 34/39; 34/218; 34/225; 432/152

[58] Field of Search ..... 34/201, 202, 39, 40, 34/209, 225; 98/115.2; 432/152, 144, 145, 148

[56] References Cited

U.S. PATENT DOCUMENTS

| | | | |
|---|---|---|---|
| 3,065,551 | 11/1962 | Cohn et al. | 34/209 |
| 4,416,068 | 11/1983 | Nilsson et al. | 34/39 |
| 4,546,553 | 10/1985 | Best | 34/39 |
| 4,600,491 | 7/1986 | Urquhart et al. | 34/39 |
| 4,662,086 | 5/1987 | Hennecke et al. | 34/39 |
| 4,665,626 | 5/1987 | Berkmann et al. | 34/39 |
| 4,733,481 | 3/1988 | Hubbert | 34/39 |
| 4,761,894 | 8/1988 | Hamasaki et al. | 34/39 |
| 4,771,728 | 9/1988 | Bergmann, Jr. | 34/39 |
| 4,785,552 | 11/1988 | Best | 34/39 |

*Primary Examiner*—Henry A. Bennet
*Assistant Examiner*—Denise L. Ferensic
*Attorney, Agent, or Firm*—Barnes & Thornburg

[57] ABSTRACT

A radiant wall drying oven that includes a first wall and a second wall situated in spaced apart relation to define an air conducting passageway. Heated air is supplied to contact the first wall, and a selected amount of heated air is allowed to pass through inlets into the air conducting passageway. Sliding dampers positioned at a predetermined site relative to the second wall control the amount of heated air contacting a portion of the second wall, and consequently regulate the amount of radiant heat emitted by that portion of the second wall.

10 Claims, 2 Drawing Sheets

CONTROL DAMPER FOR RADIANT OVEN

FIELD OF THE INVENTION

This invention relates to a radiant oven for drying objects and is more particularly concerned with control dampers that can modify the amount of radiant energy emitted by selected portions of a radiating wall of the radiant oven.

BACKGROUND AND SUMMARY OF THE INVENTION

Radiant energy resulting from infrared emission by radiating surfaces has long been used to dry or cure coated objects. Heat energy transferred to a radiating surface by convective, contact, or radiative heating can in turn be radiatively transferred to the coating of an object, speeding the natural drying process that hardens the coating on that object. An example of convective transfer of heat to a radiating surface for the purpose of drying coated objects is found in Best, U.S. Pat. No. 4,546,553 in which opposed curved walls direct infrared radiant heat against painted objects passed through an oven chamber. The walls of the oven chamber are heated by directing turbulent air against the inside surfaces of the curved wall, causing the curved walls to heat and thereby radiate increased amounts of infrared heat into the oven chamber. This apparatus has the disadvantage in that the surfaces of objects placed within the oven chamber differentially heat up to a desired temperature because each area of the object generally receives a varying amount of incident infrared energy according to its particular distance and its surface orientation in relation to the radiating wall. The coating on the object is therefore heated at different rates, adversely affecting the drying process.

One attempt to minimize the effects of differential heating of objects placed in a drying oven has been disclosed in Best, U.S. Pat. No. 4,785,552. Using a radiant wall heating oven similar to that previously described, Best '552 additionally controls the equilibrium temperature of the surface of an object in an oven chamber through the use of induced air movement within the oven chamber. Air having a lower temperature than the temperature of the curved walls of the oven chamber is circulated in a desired direction through the oven chamber to cool selected portions of the object so that the temperature of the object remains constant at all points on its surface, ensuring the even drying of the coating on the object. However, such an apparatus for controlling the temperature of the object often requires highly filtered air, precise positioning of multiple blowers to circulate air and a detailed knowledge of the amount of convective transfer of heat from the object to the cooler air.

It is therefore an object of this invention to provide an apparatus for controlling the temperature of an object placed in a drying chamber of a radiant wall drying oven.

It is a further object of this invention to control the flux of infrared radiation emitted by selected portions of an infrared radiating wall of a drying chamber of a radiant wall drying oven.

Yet another object of this invention is to provide an apparatus having one or more control dampers which regulate the amount of heated air contacting an absorbing surface of a radiant wall of a radiant wall drying oven.

Accordingly, this invention comprises a radiant wall drying oven that includes a first wall and a second wall situated in spaced apart relation to define an air conducting passageway. Heated air is supplied to contact the first wall, and a selected amount of heated air is allowed to pass through inlets into the air conducting passageway. Valves, positioned at a predetermined site relative to the second wall, control the amount of heated air contacting a portion of the second wall. Since the temperature of that portion of the second wall controls the amount of radiant heat emitted by that area of the second wall, the amount of radiant heat directed against the object is regulated.

In preferred embodiments the second wall at least partially defines a drying chamber into which objects can be individually placed in a batch process, or may be alternatively conveyed by a conveyor in a continuous process. The drying chamber can be pneumatically sealed to prevent the introduction of dust, moisture, or other substances that can detrimentally affect the drying or curing process.

Heated air can be supplied to contact the first wall by the combination of a heater for heating air, a blower for propelling the heated air toward the first wall, and a first conduit for channelling the heated and blown air to contact the first wall. The heater can be any device that acts to heat air to a desired temperature, and may be gas-fired or oil-fired. A blower suitable for impelling the heated air into the first conduit can be a propellor or other type fan.

Air inlets may constitute apertures defined within the first wall at predetermined sites. Heated air blown by a fan or other impellor through the first conduit contacts the first wall and may only enter the air passageway defined by the space between the first and second walls through these apertures. As a consequence, those portions of the second wall that are initially contacted by the heated air passing through the apertures will be most strongly heated, and consequently radiate increased amounts of infrared heat relative to those portions of the second wall that are not initially contacted by the heated air flow.

Heated air that has contacted the second wall will be cooled by the transfer of heat energy to the second wall. The cooled air can be exhausted from the drying oven, or in preferred embodiments, can be directed by a second conduit back toward the heater for heating air. Recirculating the air in this manner has has the advantage of reducing the heat required to heat the air to a desired temperature because the air, although cooled following contact with the second wall, is still significantly hotter than air at room temperature. Less heat energy is therefore required to raise the temperature of recirculated air to a desired temperature than is required for heating fresh air to the desired temperature. However, complete recirculation is generally, not advisable, since fresh air should be added to the recirculating system to replace air escaping the recirculating system and replenish the loss of oxygen during combustion processes in the heater. Also, air containing combustion products such as carbon dioxide and carbon monoxide should be exhausted to prevent the reduction in heater efficiency by stifling the combustion process.

The emission of radiant energy into a drying chamber by the second wall can be precisely controlled by the utilization of damper plates fitted over selected apertures in the first wall. By opening or closing the damper plates to a greater or lesser extent, the amount of air passing through the apertures in the first wall and convectively transferring heat energy to the predetermined portions of the second wall can be regulated. In preferred embodiments, the damper plates are fixed on the first wall to permit sliding movement of the damper plate, blocking by a desired amount the free flow of heated air through the apertures, and thereby controlling the amount of radiant heat emitted by selected portions of the second wall into the drying chamber. Such sliding dampers can be manually or automatically positioned as desired. If positioning of sliding dampers is manual, in preferred embodiments access to the sliding dampers is provided by an access door in the first conduit that permits access to the sliding dampers fixed on the first wall. The extent to which the sliding dampers block the flow of heated air through an aperture can also be determined automatically, using thermocouples or other temperature sensitive devices that provide feedback to art-recognized devices for controlling the positioning of the sliding dampers. An apparatus used in this manner can automatically control the temperature of selected portions of the second wall by opening the sliding dampers when the temperature drops below a desired predetermined value, and closing the sliding dampers when the temperature rises above the desired value.

One advantage of the invention is the greatly improved control over the temperature of selected portions of a radiating wall of a drying chamber, and consequent control over the surface temperature at all points on an object in that drying chamber. Unless an object has a surface that exactly corresponds to the radiating surface of the radiating walls of a drying chamber, the amount of incident infrared radiation impinging on the object will vary over the surface of the object. Since the rate of drying of an object coated with a liquid in a radiant drying chamber is a function of the amount of the incident radiant infrared energy, the coating on the object may differentially dry, causing adverse effects such as wrinkles or creases in the coating. The present apparatus minimizes these adverse effects by regulating the amount of incident radiant energy through the use of control dampers that control the amount of heated air contacting selected portions of the radiant wall. For example, consider an object that has a surface region closely approaching the radiating second wall toward the bottom of the object, and has a second surface region more distantly located from the radiating second wall toward the object's top. The even drying of such an object may be promoted if control dampers located on the first wall across from that portion of the radiating surface of the second wall located near the bottom of object are nearly closed to minimize the heat radiation of the second wall, and the dampers are more widely opened to increase the amount of heat transferred to those portions of the second wall positioned to radiatively heat the more distant regions of the object's surface. By appropriate positioning of apertures and control dampers, a wide variety of objects having various shapes can be evenly heated in a radiant wall drying oven according to this invention.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the following figures in which.

DETAILED DESCRIPTION OF THE DRAWINGS

Figure 1:
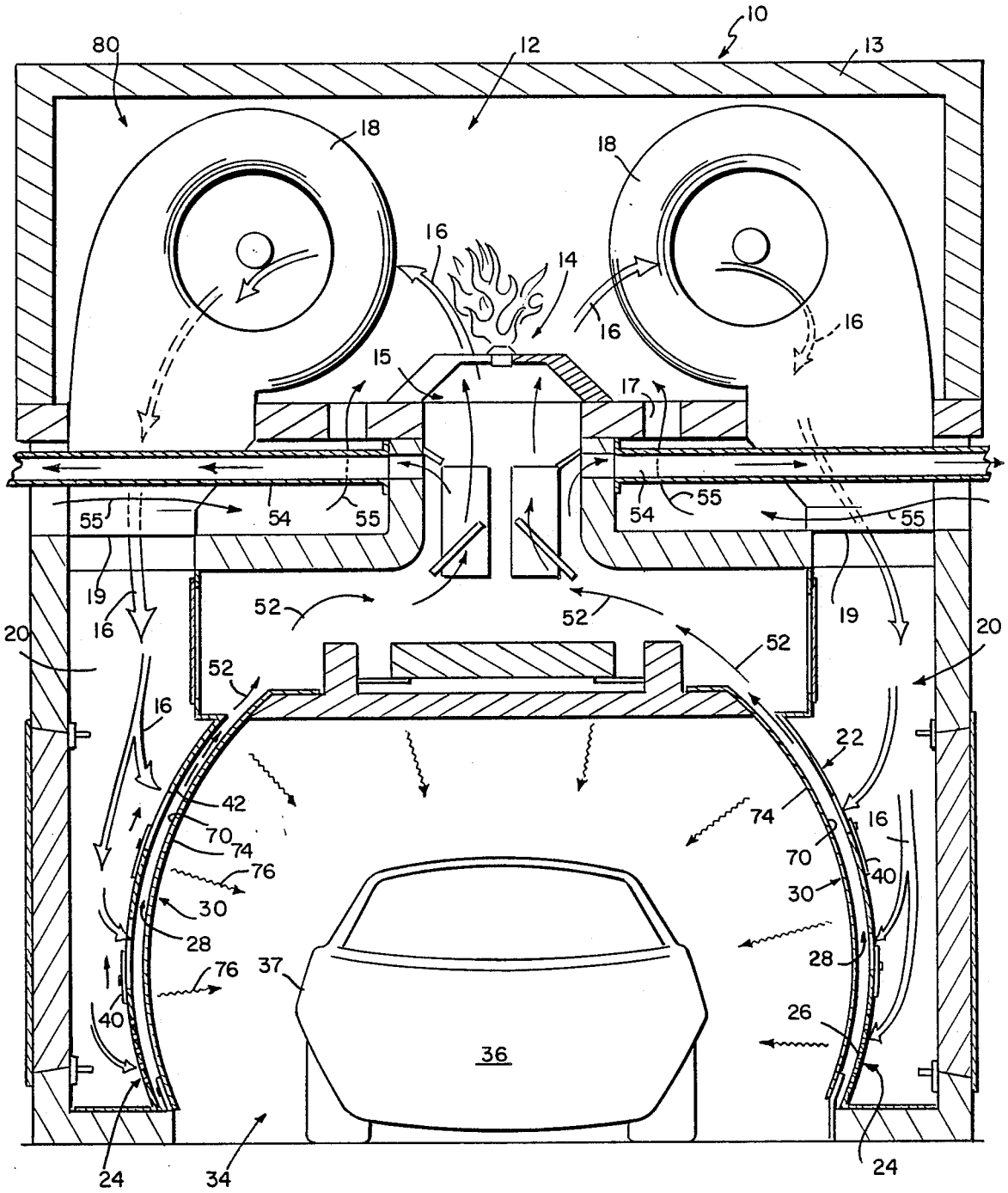
FIG. 1 is a schematic vertical section view of a portion of a radiant oven having controlling dampers constructed in accordance with the present invention.

A drying oven 10 for drying objects according to the present invention is illustrated in FIG. 1. In this description, only the left side of the oven 10 shown in FIG. 1 will be described in detail, it being understood that the right side of the oven may be allochirally arranged with respect to the left side. The illustrated oven is constructed to raise the temperature of air contained in an air heating chamber 12 defined by an air heating chamber housing 13. Air is admitted into the air heating chamber 12 through both an air inlet 15 and a fresh air inlet 17 which admits fresh air that has not been previously circulated through the drying oven 10. Any air admitted into the air heating chamber 12 is heated by a gas-fired heater 14 placed in the air heating chamber 12 to a temperature of, for instance, about 580° F. This air temperature is reached by the addition of about 2,500,000 BTU/hr of thermal energy derived from the heat of combustion of natural gas burning in the illustrated air heating chamber 12. Alternative means of heating air are also contemplated for this invention, such as heating using oil or coal fired heaters, electrical heating methods, or using waste heat derived from other processes. Presently, in most cases, the gas-fired heater 14 provides the most economical means of heating large volumes of air.

Heated air, represented by the large arrows 16 in FIG. 1, is drawn into a blower 18 which exhausts the heated air 16 from the air heating chamber 12 through an air outlet 19. The blower 18 may be a propellor, centrifugal or other type fan. The blower 18 used in an operational embodiment of this invention is capable of moving about 13,245 cubic feet per minute of heated air 16 through the air outlet 19.

The heated air 16 blown out of the air heating chamber 12 by the blower 18 is channeled by a hot air conduit 20 toward a first wall 22. The first wall 22 is formed to have hot air passageway means 24 which illustratively include a plurality of apertures 26. The apertures 26 are typically spaced longitudinally along the lower portion of the first wall 22 and permit the transfer of hot air from the hot air conduit 20 through the first wall 22 upwardly into an air passageway 28. The air passageway 28 is defined in part by the first wall 22 and a second wall 30, and is in communication with the hot air conduit 20 via the apertures 26 that collectively form the hot air passageway means 24. It will be appreciated that the apertures 26, being in the lower portion of the wall 22, will heat the lower portion of the wall 30 to a temperature hotter than its upper portion.

Figure 2:
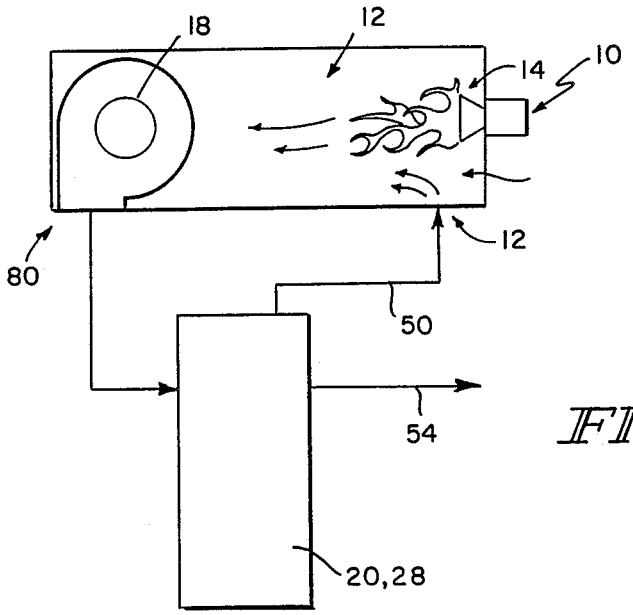
FIG. 2 is a block diagram illustrating the air circulation pattern within a radiant oven such as shown in FIG. 1.

As the heated air 16 enters the air passageway 28 it is cooled by contact with the second wall 30, becoming cooled air 52 that passes into a second conduit 50. Most of the cooled air 52 follows the path indicated by the solid arrow in the FIG. 1 into the air heating chamber 12 by way of the air inlet 15 where it is reheated as previously described, but some amount of cooled air 52 is exhausted through the air exhaust 54. The flow of cooled air 52 channeled through the air exhaust 54 is illustrated by the dotted arrows in FIG. 1. To aid in visualizing the overall flow pattern of air in the drying oven 10, a schematic block diagram of an air circulation system 80 for the drying oven 10 is shown in FIG. 2.

The hot air 16 produced within the air heating chamber 12 is used as a source of heat to enable the radiative emission of infrared heat by the second wall 30. The second wall 30 has an absorbing surface 70 and a radiating surface 74. Heat, provided by the convective contact between the absorbing surface 70 and hot air 16 moving within the air passageway 28, is transferred through the wall by conduction and emitted as infrared radiation 76 from the radiating surface 74. This infrared radiation, having a spectrum approximately equivalent to a blackbody heated to between about 400 and 430 degrees Fahrenheit, acts to cure or dry coated objects such as a automobile 36 placed within the drying chamber 34.

Because objects such as automobile 36 have an irregular shape, the amount of infrared radiation 76 incident at any point or a coated surface 37 of the automobile 36 may vary. However, since this variance in incident infrared radiation 76 causes differential heating of the coated surface 37, the coated surface 37 may form creases or wrinkles during the drying process. To evenly dry all points of the coated surface 37, the present device causes predetermined areas of the second wall 30 to emit a greater flux of infrared radiation 76, so that those areas of the coated surface 37 originally receiving lesser amounts of infrared radiation 76 will be heated to the same temperature as other points on the coated surface 37 of the automobile 36. Increasing the flux of infrared radiation 76 is achieved by local increases in the temperature of predetermined portions of the radiating surface 74 of the second wall 30. The temperature increases are enabled by increasing the amount of heat transferred from the hot air 16 to those predetermined portions of the absorbing surface 70 of the second wall 30.

Figure 4:
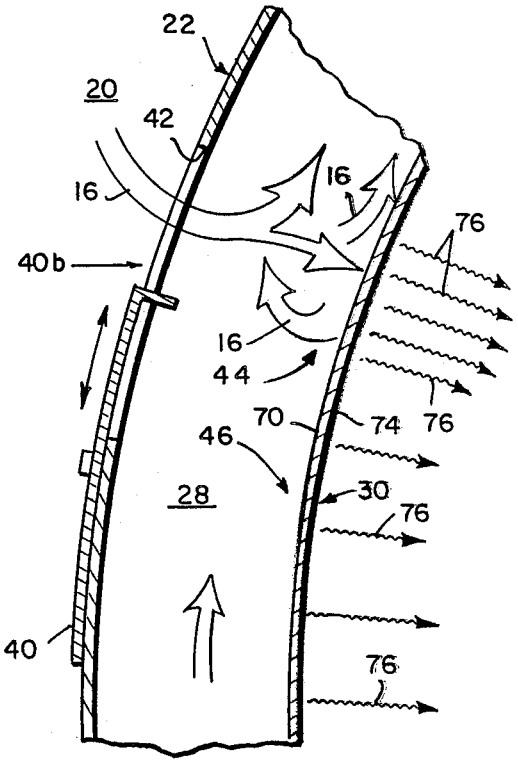
FIG. 4 is a side view of the first wall and a second wall which are positioned to define an air passageway into which air passing through an aperture in the first wall can pass in an amount controlled by the position of the sliding damper over the aperture.

Increasing the amount of heat transferred is achieved by controlling the direction of the flow of hot air 16 into the air passageway 28. The flow of heated air 16 from the hot air conduit 20 into the air passageway 28 is precisely regulated by the placement of damper aperture 42 at a predetermined position in the first wall 22. As best shown in FIG. 4, heated air 16 passes through damper aperture 42 and strikes the absorbing surface 70 of the second wall 30. By transfer of thermal energy from the hot air 16 to the absorbing surface 70 of the second wall 30, the hot air 16 is cooled to become cooled air 52 and the second wall 30 forms a high heat region 44 about the area of initial contact with the hot air 16. Regions of the second wall 30 that are not directly contacted by the flow of hot air 16 through the apertures 26 are heated nonetheless by conduction and contact with cooled air 52, but will generally have a lower temperature than the high heat region 44, and are therefore termed a low heat region 46.

Figure 3:
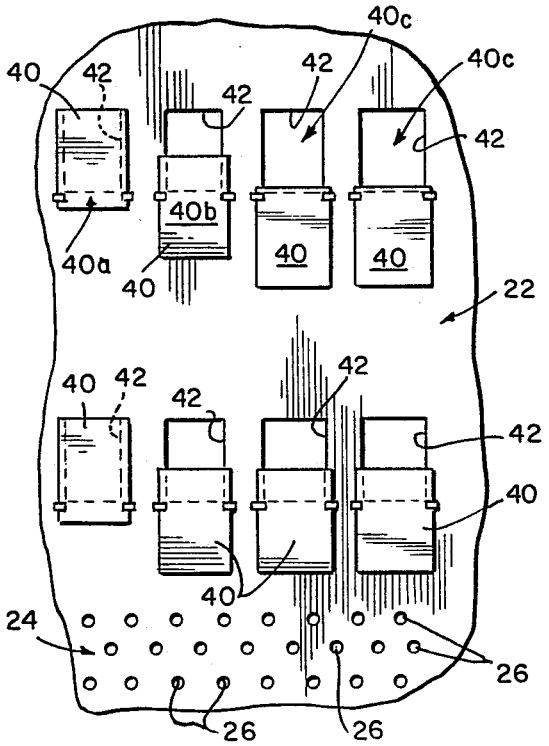
FIG. 3 is a partial view of a first wall defining apertures which can be blocked by sliding dampers according to the present invention.

The extent to which the high heat region 44 is heated by convective contact with hot air 16 can be further controlled by regulating the amount of hot air 16 passing through the damper aperture 42 to contact the absorbing surface 70 of the second wall 30. As best shown in FIGS. 3 and 4, sliding dampers 40 can be slidably attached to the first wall 22 selectively to close their associated damper apertures 42. The sliding dampers 40 can be fixed in completely closed positions to block the flow of hot air 16 as shown in 40*a*; to partially block the flow of hot air 16 as shown in 40*b*, or completely open so that the flow of hot air 16 through the damper aperture 42 is not impeded as shown in 40*c*.

Since the high heat region 44 has a greater flux of infrared radiation 76 than the low heat region 46, as a result of the careful positioning of damper apertures 42, apertures 26 and sliding dampers 40, some drying problems with variable shape objects can be alleviated. For instance, the automobile 36 whose coated surface 37 would receive a varying amount of incident infrared radiation 76 if the radiating surface 74 had a constant temperature, can be more evenly dried if damper apertures 42 with sliding dampers 40 are provided to admit a controlled amount of hot air 16 to contact those portions of the second wall 30 that are furthest removed from coated surface 37 of the automobile 36.

As best shown in FIG. 3, in preferred embodiments a plurality of apertures 26 and damper apertures 42 having a range of sizes are defined by the first wall 22. The damper apertures 42 can be unblocked to ensure an unimpeded flow of hot air 16 from the hot air conduit 20 into the air passageway 28, or the damper apertures 42 may be blocked by a plurality of sliding dampers 40 to prevent the flow of hot air 16 into the air passageway 28. Both the apertures 26 and the damper apertures 42, along with any sliding dampers 40, are in preferred embodiments serially arranged in parallel rows throughout the first wall 22. This arrangement provides great flexibility in regulating the amount of hot air 16 that is permitted to initially contact a predetermined portion of the absorbing surface 70 of the second wall 22 in order to ensure the production of a high heat region 44, or the continued maintenance of a low heat region 46.

Access to the sliding dampers 40 is through an access door 60 forming a part of the hot air conduit 20. The access door 60 is removed, and an operator can reach inside the hot air conduit 20 to manually set the positions of the sliding dampers 40. Other means of setting the position of the sliding dampers 40 are also contemplated for this invention, and automatic or other type systems known to those skilled in the art of controlling valve devices can be used to regulate the blocking or unblocking of the apertures 16 by the sliding dampers 40.

It will be obvious to those skilled in the art that many variations can be made in the embodiments presented herein for the purpose of illustrating the present invention with departing from the scope of the invention as defined in the following claims.

What is claimed is:

1. A drying oven comprising first wall and a second wall situated in spaced apart relation to the first wall to define an air conducting passageway therebetween, said second wall defining, at least in part, a chamber in which objects are to be irradiated with infrared energy from said second wall, supply means for providing heated air to contact the first wall, inlet means for conducting heated air through the first wall into said air conducting passageway, and valve means for selectively controlling flow of heated air generated by the supply means through said inlet means into the air conducting passageway.

2. The apparatus of claim 1 wherein the supply means includes a heater means for heating air, a blower means for blowing air heated by the heater means, and a first conduit means for directing heated air blown by blower means to contact the first wall.

3. The apparatus of claim 1 further including second conduit means, connected between the air conducting passageway and the supply means, for recirculating heated air.

4. The apparatus of claim 1 wherein the inlet means includes a plurality of apertures defined by the first wall.

5. The apparatus of claim 1 wherein the valve means includes a damper plate attached to the first wall for sliding movement thereon.

6. The apparatus of claim 4 wherein at least some apertures have air flow controlled by the valve means which includes at least some damper plates slidably attached to the first wall.

7. The apparatus of claim 6 wherein said damper plates are serially arranged to cover correspondingly arranged apertures defined by the first wall.

8. In a radiant oven for drying coated articles, said oven being of the type having first and second walls forming a heated air passageway therebetween with said second wall serving as a radiating surface for said oven and with said first wall having apertures therein which admit heated air to said passageway, the improvement comprising a plurality of selectively placed dampers on said first wall selectively to close additional apertures therein, thereby selectively to heat portions of said second wall in close proximity to said dampers.

9. A method for evenly drying coated objects with a radiative oven comprising the steps of, providing a radiative wall having an absorbing surface to absorb heat and an appropriate radiating surface to emit infrared radiation, contacting a predetermined portion of the absorbing surface of the radiative wall with an amount of heated air, regulating the amount of heated air contacting the predetermined portion of the absorbing surface of the radiative wall by providing a first wall defining an aperture and a control damper fitted to limit the amount of heated air passing through the aperture in the first wall to contact the predetermined portion of the absorbing surface of the radiative wall.

10. A radiant oven comprising internal side walls arranged to direct infrared energy at objects in said oven and outer side walls spaced outwardly from said internal side walls to provide a heated air passageway therebetween, said outer side walls having apertures at their lower portions to admit heated air to said passageway to move upwardly therethrough to heat said internal side walls, and means for selectively heating portions of said internal side walls to higher temperatures, said selective heating means including a plurality of additional apertures in said outer side walls opposite said portions, respectively, of said internal side walls, and moveable dampers for selectively closing said additional apertures.

* * * * *